United States Patent [19]

Bourke et al.

[11] 4,026,506

[45] May 31, 1977

[54] TRANSMITTING LOOP ARRANGEMENT FOR RAILROAD CAB SIGNAL AND SPEED CONTROL SYSTEM

[75] Inventors: Thomas J. Bourke, Plum Borough; Kenneth J. Buzzard, Pittsburgh, both of Pa.

[73] Assignee: Westinghouse Air Brake Company, Swissvale, Pa.

[22] Filed: Aug. 31, 1976

[21] Appl. No.: 719,336

[52] U.S. Cl. ..... 246/34 R; 246/63 R; 246/187 B; 246/187 C

[51] Int. Cl.[2] ..... B61L 21/06; B61L 21/08

[58] Field of Search ..... 246/187 B, 187 C, 182 R, 246/182 B, 167 R, 63 A, 63 C, 63 R, 34 R

[56] References Cited

UNITED STATES PATENTS

| | | | |
|---|---|---|---|
| 3,402,289 | 9/1968 | Burke | 246/187 B |
| 3,501,629 | 3/1970 | Aiken | 246/187 B |
| 3,868,075 | 2/1975 | Blazek | 246/63 R |

FOREIGN PATENTS OR APPLICATIONS

| | | | |
|---|---|---|---|
| 1,951,048 | 5/1971 | Germany | 246/187 B |

*Primary Examiner*—Trygve M. Blix
*Assistant Examiner*—Reinhard J. Eisenzopf
*Attorney, Agent, or Firm*—A. G. Williamson, Jr.; R. W. McIntire, Jr.

[57] ABSTRACT

A wire loop for carrying cab signal or speed control commands is laid parallel to the rails along the track center line except at the exit end of each section where an offset portion of this loop is laid immediately adjacent one rail to form a cut-in signal source. A second loop is laid along the center line of the rails through this offset distance, which is equal to the stopping distance of the train from the restricted speed rate, and each loop is supplied by the same cab signal transmitter. Each train carries receiver coils positioned above the center line loops and above the cut-in loop positions. The normal cab signal or speed control apparatus is controlled by the signal picked up by the receiver coil above the centerline loops in the track. A separate cut-in receiver is controlled by signals picked up from the offset portion of the main loop but responds only to a proceed signal command. Interruption of signal transmission to the second loop when the advance track section is occupied halts a train moving in the approach section and cuts off the cab signal apparatus by interrupting a stick circuit of a cab signal control relay. When the cut-in receiver again responds to a proceed signal command, transmitted after the advance track section is again unoccupied, it energizes a cut-in relay which picks up the cab signal relay to again complete its stick circuit and activate the normal cab signal apparatus.

15 Claims, 2 Drawing Figures

TRANSMITTING LOOP ARRANGEMENT FOR RAILROAD CAB SIGNAL AND SPEED CONTROL SYSTEM

BACKGROUND OF THE INVENTION

Our invention relates to a transmitting loop arrangement for a vehicle cab signal control system. More specifically, the invention relates to wire loop arrangements by which cab signal or speed control commands are transmitted to trains moving along a railroad track with safety features to eliminate or prohibit the unsafe condition of a train receiving and responding to a signal command intended for a preceding train.

On occasion in a railroad signaling system, especially in a rapid transit train control arrangement, it is advantageous to transmit the cab signal or speed control commands from the wayside control apparatus to the train carried apparatus through wire loops laid parallel to the rails rather than transmitting such signals through the rails themselves. Such an arrangement is applicable to a rapid transit system where short track sections and close headway are desired. Further, in an electrified railroad or rapid transit installation, the wire loops for cab signals make it easier to provide the propulsion current return circuits. Among the advantages of using a loop transmitting arrangement are negligible noise in the transmitted signals induced from the propulsion current, sneak circuit paths for cab signal energy, e.g., through impedance bonds, are not as likely to occur, train carried apparatus does not have to respond to as wide a range of signal levels, and complications of connections to the rails to supply the cab signal energy are eliminated. However, one problem when using loops in this manner for transmitting the cab signal commands to the train is the possibility of a following train also receiving the signal intended for the leading train. This can occur since the loops are not shunted by the train wheel and axle sets, as are the rails, to limit the transmission of the signals behind the train. This problem creates a possibility of an unsafe condition existing in the train operation with the following train receiving a proceed indication which is incorrect and unsafe. A special arrangement or pattern of transmission loops in the selection of the signals transmitted can provide a solution to this problem.

Accordingly, an object of our invention is an improved arrangement of transmitting loops for cab signal commands which prevent the occurrence of unsafe operating conditions.

Another object of the invention is a transmitting loop arrangement for cab signal or speed control commands which inhibits the operation of a following train into a section occupied by a preceding train.

Still another object of the invention is a loop arrangement for transmitting cab signal operating commands to vehicles moving along a stretch of roadway which cuts off the operation of the vehicle carried apparatus to halt an approaching vehicle prior to its entry into the section occupied by the preceding vehicle.

It is also an object of the invention to provide an arrangement of transmitting cab signal and speed commands, from the wayside to train carried apparatus along a stretch of track, which includes wire loops laid parallel to the rails and positioned in each section to couple with train carried apparatus in a preselected pattern to cut off the operation of the train apparatus when the next advance track section is occupied.

Still another object of the invention is a cab signal arrangement for a stretch of railroad track using wire loops in preselected patterns laid parallel to the rails to carry cab signal commands from the wayside controls and a plurality of receiver coils mounted in preselected positions on the train to couple with these loops to transfer the signals to the train apparatus.

Still another object of the invention is a cab signal and speed control system for a stretch of railroad track using a plurality of wire loops laid in preselected patterns between the rails to carry the commands section by section to the train and a plurality of receiving coils mounted in preselected positions on each train to couple with the track loops in order to pick up wayside signals to govern train movement in accordance with advance traffic conditions and to cut off the train apparatus operation at the exit end of a section when the next advance section is occupied so that the following train does not receive and respond to signals transmitted to the preceding train.

Other objects, features, and advantages of our invention will become apparent from the following specification and the accompanying drawings when considered with the appended claims.

SUMMARY OF THE INVENTION

In practicing our invention, a first transmitting loop is laid parallel to the rails in each of the consecutive track sections in a stretch of track with the longer portion of the loop located midway between the rails. At the exit end of the section, however, a shorter portion of this first loop is offset so that it is positioned immediately adjacent one of the rails, shown specifically as the right-hand rail in the direction of operation. A shorter second transmitting loop of the same length as the offset portion is then positioned along the center line between the rails from the offset location to the end of the section. Thus, over this preselected length at the exit end, there are two transmitting loops, one in the center of the track and one adjacent the right-hand rail. The preselected length is based on the stopping distance of the train from a very slow or restricted speed limit. If the stretch of track is used for two direction train operation, a similar offset section of the first or main loop and a similar second loop are located at each end of the section; that is, at the exit end for each direction of operation. A cab signal or speed command transmitter is coupled to the first loop at the exit end of a section. This transmitter generates a coded command signal for transmission over the first loop. The characteristics or code rate of the selected signal, which determines allowed train speed, is in accordance with the position of preceding trains as determined by a logic arrangement means responsive to the traffic conditions in advance of the particular section. The same speed or signal command is normally also transmitted into the second loop at the exit end of the section. Each section is further supplied with a train occupancy detector shown as a simple track circuit with a detector track relay. The application of the speed command from the cab signal transmitter to the second loop is then governed by the track relay for the advance track section which interrupts the transmitter coupling to the second loop if the advance section is occupied by a train. The advance section track relay also governs the supply of enabling energy to the logic means, normally supplying this operating energy as long as the advance section is unoccupied. The signal command being transmitted through the corresponding first loop of the advance section is applied to the logic means and is used to determine the selection of the cab signal or speed command applied to the associated track section loop. When the advance section is occupied, the enabling circuit is interrupted to the logic means and the corresponding energy is applied to the STOP signal command input for the approach section cab signal transmitter. Actually, the STOP command is in effect a very slow or restricted speed command which causes the train to move at a low speed, normally less than 5 miles per hour. Other speed indications provided by the transmitter are defined here as being a maximum, a medium, and a minimum speed, which allows the train to advance at preselected speed rates corresponding to each of these defined terms, the actual speed varying in accordance with the requirements of a particular transit installation.

The train carried apparatus includes a cab signal apparatus, a cut-in receiver, and two or three receiving coils. One receiving coil is assigned to the pick-up of the cut-in command and the other one or two coils pick up the speed commands for the cab signal apparatus. These coils are mounted on the front of the train so as to inductively couple with the various wire loops. The receiving coil associated with the cut-in receiver is mounted on the right front of the train in the specific showing so that it will couple with the offset portion of the first or main transmitting loop. The principal receiving coil associated with the cab signal apparatus is mounted in the center of the train to couple with the main portion of the first transmitting loop and with the second transmitting loop at the exit end. If the train is equipped for use in two direction operation territory, a second receiving coil for the cab signals is mounted on the left front of the train to couple with the other offset portion of the first transmitting loop which is positioned at the entrance end of the section in the direction of which the train is operating. This assures continuous pick-up of the cab signal commands. This third coil need only be mounted if two direction operation is intended. The second and third coils, if both are used, are coupled together to supply the received signals to the cab signal apparatus while the first coil is obviously coupled to supply energy to the cut-in receiver during the time that the train is passing over the offset portion of the first loop.

The cab signal apparatus receives and responds to the cab signal or speed commands only if a cab signal control relay is picked up to enable the apparatus, that is, to supply operating energy as specifically shown. This cab signal relay is normally energized by a stick circuit which remains completed while the cab signal commands are being received and the apparatus is active. In other words, the cab signal control relay is normally energized while the train is passing over the first and second transmitting loops if cab signal or speed commands are being supplied thereto. If no signal is received, particularly in the second loop section, the cab signal relay is released since its stick circuit is interrupted by the lack of reception of a signal in the cab signal apparatus. This, of course, cuts off or halts further operation of the cab signal apparatus until the control relay is reenergized by the cut-in signal. This is controlled by a cut-in relay which is energized by the cut-in receiver when a signal is received during passage over the offset portion of the first loop which will allow the train otherwise to proceed along the track stretch. In other words, if other than a STOP command is being transmitted to the first loop, the cut-in receiver actuates the corresponding cut-in relay briefly. The pick-up of this latter relay reenergizes the cab signal relay which picks up to restore the cab signal apparatus to its operable condition. Once picked up, the cab signal relay sticks in its picked up condition to allow the apparatus to continue to operate as the train advances into the next track section. Conversely, when a train is moving through a section under a STOP or restricted speed command, that is, with the advance section occupied, the cab signal apparatus is cut off when the center receiving coil passes from the first to the second transmitting loop because the second loop is deenergized with the advance section occupied. The cab signal relay then releases since the cut-in relay is not picked up with a STOP command in the offset portion of the first loop. In order for the train to resume its advance at a subsequent time, a proceed signal in the offset portion of the first loop must be received by the cut-in receiver to pick up the cut-in relay which in turn picks up the cab signal relay, resetting the cab signal apparatus, that is, enabling it for further operation. Since a proceed indication will then also be received from the second loop, the train is authorized to advance into the next section. Modifications and operation of the apparatus when two direction operation of the trains is in effect on a stretch of track will become apparent from the specific description hereinafter.

BRIEF DESCRIPTION OF THE DRAWINGS

We shall now describe a specific arrangement of our invention, as shown in the accompanying drawings, and then define the novelty thereof in the appended claims. In the Drawings:

Figure 1:
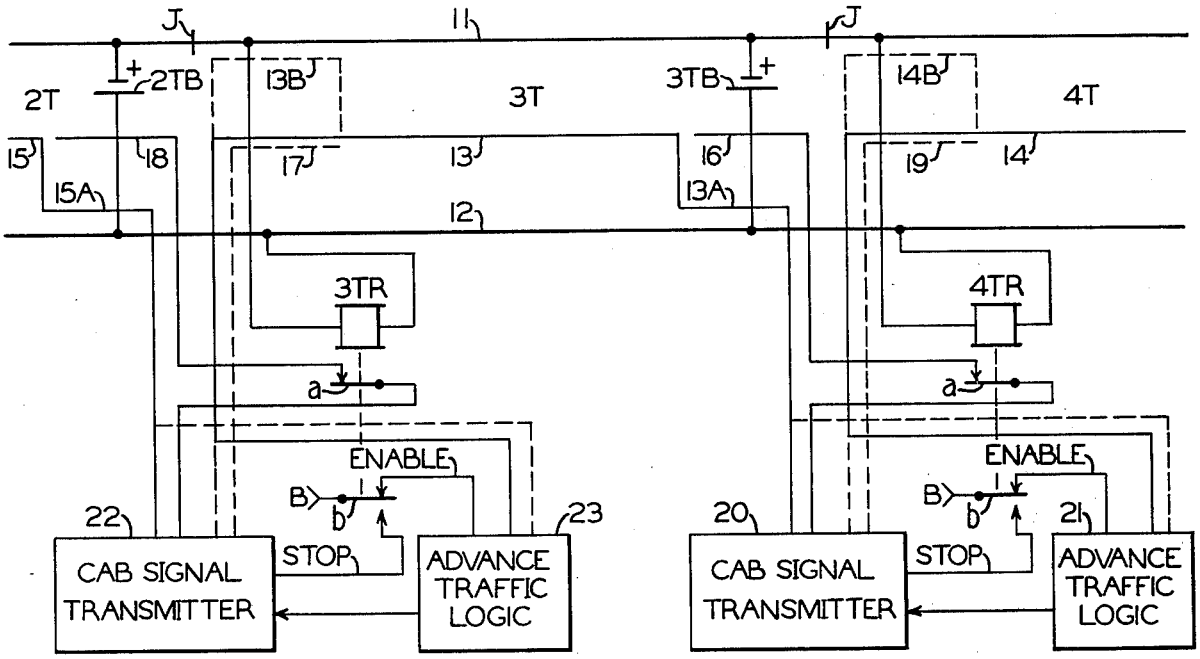
FIG. 1 is a schematic diagram of the wayside apparatus, including the track loops associated with a single track section, for a cab signal system embodying our invention.

In each of the drawing figures, each wayside location and on the train, a source of direct current energy is provided to supply operating energy to the relays and other apparatus involved. The source is not specifically illustrated since such use is conventional. Rather, the positive and negative terminals of these sources are represented by the reference characters B and N, respectively, and the appearance of either of these reference characters represents a connection to the corresponding terminal of the local direct current source.

DESCRIPTION OF THE ILLUSTRATED EMBODIMENT

Referring now to FIG. 1, a stretch of railroad track is illustrated by the lines 11 and 12 across the top of the drawing which represent the rails of the track. While trains may move in either direction, this is not critical to the discussion of the invention which applies also to track over which trains move in a single direction only. When a direction is discussed for later reference, the eastbound direction describes the trains moving to the right while a westbound train moves to the left in the stretch of track. This track is divided into sections by insulated joints designated by the reference J shown only in the single rail 11. Thus, reading from left to right, sections 2T, 3T and 4T are illustrated with only section 3T being shown in its entirety. Each section is provided with a track circuit for the detection of occupying trains and, of course, shown as being of the single rail type. Each track circuit is shown conventionally as a direct current circuit including a track battery, a track relay and the section rails. It will be understood that alternating current track circuits may also be used if desirable and customary in the stretch shown. For section 3T, the track circuit includes the track battery 3TB shown connected across the rails at the east or right end of the section and the track relay 3TR shown connected across the rails at the left or west end of the section. In a manner well understood, relay 3TR is normally energized, with its contacts picked up, and releases when a train occupies any portion of section 3T between the insulated joints J shown at the left and right of this section. For section 4T, the track relay 4TR is shown which operates in a similar manner to detect trains occupying that section. The track battery 2TB is shown connected across the rails at the east end of section 2T and a similar track relay would be connected across the other end of the section. Track relays 3TR and 4TR are shown with their contacts in the position to which operated when no train is occupying the corresponding section, that is, front contacts are closed. Single rail track circuits assist in providing an electric propulsion return current circuit through the rails. However, if it is desired to fully insulate each section by joints in each rail, impedance bonds may be added in a conventional manner to provide the propulsion current return path.

To provide for the transmission of cab signal or speed command energy for pick up by the train carried apparatus, wire loops are laid in each section. This is in lieu of transmitting the cab signal or speed command energy through the rails, which is also a known method. In section 3T, the first or principal cab signal transmitting loop is illustrated by the single line 13 shown parallel to the rails of the section. Actually, the line 13 represents a two wire circuit carrying the signaling current from the transmitter at, for example, the east end of this section to a receiver at the west end which is part of the logic means to be shortly described. These transmitter and receiver units, of course, are wayside apparatus. It will be noted, that, in general, loop 13 lies along the center line of the track, midway between the two rails. However, at the east end of section 3T, the exit end for eastbound trains, loop 13 is offset from the midpoint and laid immediately adjacent to the right-hand rail 12. This offset portion 13A is of a preselected length which will be equal to or slightly more than the braking distance of the train from the restricted speed level set for the system, which will be on the order of 5 mph or less. The preselected length also includes, of course, a safety factor allowing for the reaction time of the train carried apparatus and any allowable speed error in the operation of the train. A similar offset portion 13B shown by the dashed line at the left end of section 3T will be installed if two direction operation of trains over the stretch of track prevails. Loop portion 13B will be of the same preselected length as portion 13A. However, for most of the remaining discussion, single direction operation in the eastbound direction will be considered to prevail in the system illustrated. It will be noted that the offset portions of loop 13 are indicated as being adjacent to the right-hand rail in the direction of a train movement in which they govern, but it will be obvious that the offset could be adjacent the left-hand rail in the direction of movement if the system is so designated. Sections 2T and 4T have similar first loops, portions of which are shown by the lines 15 and 14, respectively, in these two sections. The eastbound offset portion 15A is shown in section 2T while the offset portion 14B, used if westbound train movements are also required, is illustrated by a dashed line in section 4T.

Each section also has a second transmitting loop such as 16 in section 3T at the eastbound exit end of the section. Once again, the line 16 represents a two wire circuit laid along the center line between the rails and of the same preselected length as the offset portion 13A of the principal loop. When both direction operation is used, section 3T needs another second loop which is represented by the dashed line 17 at the westbound exit end. This is similar to the loop 16, that is, is a two wire circuit laid along the center line and equivalent in length to the offset portion 13B of the main or principal loop when used. Section 2T has a second loop represented by the line 18 while section 4T, for two direction operation, has a westbound second loop represented by the dashed line 19 which is placed along the center line when the offset portion 14B exists.

Signals transmitted in the first and second loops are supplied by a cab signal or speed command transmitter coupled to the loops at the exit end of the section, that is, at the established exit end where two direction operation is used. For example, the cab signal transmitter block 20 at the eastbound exit end of section 3T provides the signals for loops 13 and 16. Transmitter 20 is directly connected to loop 13 including its various offset portions, but the coupling to loop 16 from transmitter 20 is carried over front contact *a* of track relay 4TR of section 4T. Transmitter 20 is shown as a conventional block since any one of several known types of apparatus may be used for this purpose. For example, the cab signal transmitter may be adapted from that shown in the U.S. Pat. No. 3,794,833, issued to Blazek et al on Feb. 26, 1974, for a Train Speed Control System. Particular reference is made to FIGS. 2A and 2B of this patent for a cab signal transmitter apparatus. Another form is shown in the copending application for United States patent, Ser. No. 719,337 filed Aug. 31, 1976 by K. J. Buzzard for a Wayside Signaling Arrangement for Railroad Cab Signal and Speed Control System, both applications having a common assignee. The speed command transmitted, for example, a code rate modulating a basic carrier frequency, is selected by an associated advance traffic logic apparatus also shown by a conventional block 21 so labeled. Examples of such a logic means may be found in the aforementioned U.S. Pat. No. 3,794,833 and, in another form, in the U.S. Pat. No. 3,868,075 issued to F. V. Blazek et al on Feb. 25, 1975, for Jointless Coded Track Circuits For Railroad Signal Systems. Another specific example, for particular use with two direction train operation, is also shown in the previously referenced application Ser. No. 719,337. In other words, the logic means 21 selects and may supply a specific code rate or frequency signal which modulates the basic cab signal carrier frequency generated by transmitter 20 and output as the selected speed command signal transmitted through loops 13 and 16 for pick-up by the train carried apparatus. It is also to be noted that, if track relay 4TR releases because section 4T is occupied by a preceding train, its contact *b* opens the ENABLE or energy supply circuit to logic means 21 and transfers the operating energy direct to transmitter 20 to activate a transmission of a STOP or restricted speed command. At the same time, with front contact *a* of relay 4TR open, the STOP command is not transmitted through loop 16, that is, when relay 4TR is released because of occupancy of the track section. Loop 16 is thus deenergized and carries no signal command for pick-up by the train in the manner shortly to be described. The STOP command designated as transmitted by unit 20 is actually a very slow or restricted speed command requiring that the train speed be, for example, less than 5 mph.

A similar transmitter 22 and logic apparatus 23 controls the application of speed command signals to loops 15 and 18 of section 2T. Energy loop 18 is carried from the transmitter over front contact *a* of relay 3TR so that no command signals are supplied if section 3T is occupied. Loop 13 in section 3T is coupled to the advance traffic logic apparatus 23 to provide information of the speed command signals existing in the loops of section 3T. These signals control, at least in part when relay 3TR is picked up, the selection of the code rate or frequency signal selected by unit 23 and transmitted by unit 22. When relay 3TR is released, with section 3T occupied, energy supplied over back contact *b* of relay 3TR actuates transmitter 22 to generate and transmit the STOP command through loop 15.

If the stretch of track is equipped for train operation in either direction, in accordance with the selectively established traffic direction, loop 13 is connected by traffic control means or devices, when westbound traffic is established, to transmitter 22 rather than logic means 23. In a similar manner, loop 15 (15A) is then connected to logic means 23 to supply advance traffic information to govern the selection of cab signal commands transmitted through loop 13. The westbound second loop 17 is also selectively coupled to transmitter 22. At the other end of section 3T, the traffic control devices, under westbound traffic, selectively shift the connections of loop 13 (13A) to logic means 21 and connect loops 14 (with 14B) and 19 to transmitter 20. The couplings for loops 17 and 19 to the associated transmitters will each include a contact (not shown) responsive to the occupancy condition of the associated advance track sections 2T and 3T, respectively.

Figure 2:
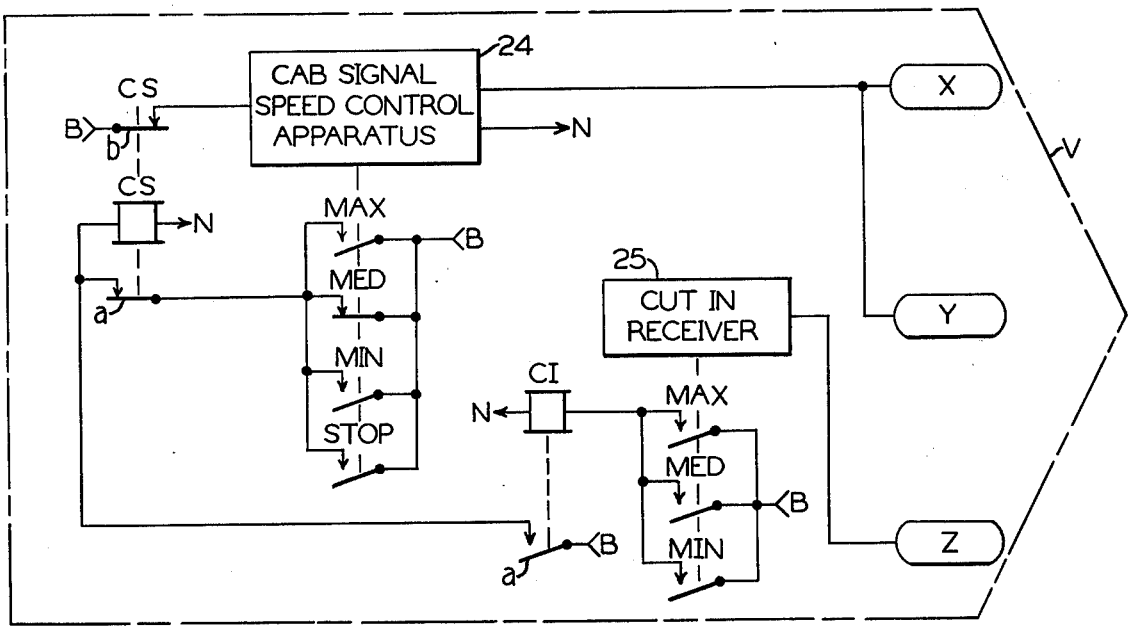
FIG. 2 is a schematic diagram of train carried cab signal apparatus which is controlled by the wayside apparatus of FIG. 1.

The train carried apparatus which cooperates with and is controlled by the wayside apparatus previously described is illustrated in FIG. 2, to which reference is now made. The dot-dash outline block V in FIG. 2 represents the lead vehicle of a train or a single unit rapid transit car traversing the stretch of track including sections 2T, 3T and 4T of FIG. 1. The block symbol V, as is obvious, designates a train moving to the right in the eastbound direction along the track. Mounted underneath the front of the train are three receiver coils represented by the symbols X, Y, and Z. Coils X and Y are used for cab signal or speed command pick-up and coil Z for picking up the cut-in signals that will be described. These coils are mounted to ride directly over the associated or corresponding track loops. For example, receiver coil Z is mounted in the right front corner so that it rides in an inductive relationship with the offset portions A of the various first track transmitting loops in each section, such as offset portion 13A. Coil Y is positioned so that it is above the main portion of the first transmitting loop, such as 13, or the second loops such as 16 or 17 and will inductively couple with these loops. Receiver coil X is actually intended for coupling with the other offset portion 13B of the first transmitting loop where two direction operation is used, since the cab signal or speed commands must be picked up from this offset portion as an eastbound train moves through the stretch. If nothing but single direction operation is used in the entire system, that is, no portion of the track is ever used for opposite direction movements, the receiver coil X can be omitted from the train carried apparatus.

The receiver coils X and Y, where both are used, are connected in multiple so that the inductively produced output from each coil may be applied to a single unit of apparatus. These output signals from receiver coils X and Y are applied to the cab signal, speed control apparent illustrated by the conventional block 24. Any known type of such apparatus, modified as necessary to respond to signals from a track loop rather than from both rails, may be used in this system. The response of the apparatus in accordance with the modulated signal received closes one of the contacts shown controlled by a dotted line and designated as MAX, MED, MIN, and STOP. These designations represent the speed allowed under the conditions of that received signal. In other words, when contact MAX is closed, the maximum allowed speed for the system or track stretch may be achieved by the train operation. Medium and minimum speeds, at preselected lower levels, are in effect when the corresponding MED and MIN contacts are closed. When the STOP contact is closed, a restricted speed signal is in effect, which is a very low speed and used for the purpose which will be further discussed. Only a single set of contacts controlled by cab signal apparatus 24 are shown, but other similar contacts will be provided to actuate the display of a cab signal indication and specifically control the speed and propulsion apparatus functions.

Cab signal apparatus 24 is operable only when it is energized by connection across the direct current source, that is, terminals B and N. This connection is controlled by front contact *b* of a cab signal control relay CS. Relay CS is normally energized by a stick circuit including its own front contact *a* and multiple connections to terminal B over apparatus 24 controlled contacts MAX, MED, MIN, and STOP. The specific circuit in force in the illustrated arrangement is from terminal B over contact MED and front contact *a* of relay CS to the relay winding and thence to terminal N, it being assumed that a medium speed condition is in effect. Only one of the cab signal apparatus contacts is closed at a time so that only a single connection is completed. However, these contacts, by the nature of the apparatus, are slow releasing so that when a shift between speed conditions occurs, the stick circuit connections to terminal B are bridged and not interrupted under such operation. Obviously, if train coil Y is over a deenergized loop 16, as occurs when section 4T is occupied, the stick circuit for relay CS is interrupted, since all contacts are open, and relay CS will release since its pick-up circuit is also open. When relay CS releases, cab signal apparatus 24 is deenergized by the opening of front contact *b* of relay CS and, with no speed control command generated, the train halts.

The pick-up circuit for relay CS includes front contact *a* of the cut-in relay CI. Relay CI is controlled by the cut-in receiver unit 25 which is in turn responsive to the signal output from receiver coil Z. The cut-in receiver 25 is somewhat similar to the cab signal apparatus 24, but responds only to the three proceed speed commands, that is, the MAX, MED, and MIN signals received from the loop portion 13A. In a manner similar to unit 24, unit 25 closes one of three contacts in accordance with the specific command picked up by receiver coil Z. As already explained, coil Z picks up a signal only when the train is over the offset portion 13A of the first loop. The signal command in loop portion 13A, of course, is the same as that in loop 13. When cut-in receiver 25 responds, relay CI is picked up to close its front contact *a* and reenergizes relay CS. Since this occurs only when a proceed signal MAX, MED, or MIN is present in the various loop, once relay CS picks up to close its front contacts, the cab signal apparatus responds to close a corresponding contact and the stick circuit is reinstituted. Relay CS thus remains picked up when the train passes off loop portion 13A. When a STOP command flows in loop 13 and offset portion 13A, cut-in receiver 25 does not respond and, therefore, relay CI is not picked up, so that the interruption of the stick circuit for relay CS due to a deenergized loop 16 is effective to deenergize the relay and cause its release, thus shutting off cab signal apparatus 24.

We will now describe briefly the operation of the apparatus which is relatively obvious from the preceding description. If section 4T is unoccupied, logic unit 21 actuates transmitter 20 to generate and supply into loop 13 at least a minimum speed signal command. If additional advance sections to the right from section 4T are also unoccupied, the speed command provided to loop 13 improves to the medium or maximum speed level. With relay 4TR picked up, and its front contact *a* closed, a similar command is also provided into loop 16 by transmitter 20. As the train V moves to the right through section 3T, receiver coil Y inductively picks up the command signal in loop 13 and supplies it to cab signal apparatus 24. Assuming that relay CS is picked up and held by its stick circuit, the cab signal apparatus responds to allow the train to continue its movement. At least the MAX, MED, or MIN contact will be closed by unit 24 so that the stick circuit for relay CS remains completed. If portion 13B of the first transmitting loop is installed, the same signal is picked up by receiver coil X on train V so that a similar condition exists when the train first enters section 3T. Since loop 16 has the same signal commands supplied to it, the signal output from receiver coil Y will be the same as the train traverses the exit of section 3T. The cab signal apparatus thus holds in the same condition due to the signal picked up from loop 16 and the train continues in the eastbound direction. With a minimum speed or better signal in portion 13A of the loop, coil Z will pick up a signal to activate cut-in receiver 25 which in turn energizes relay CI by closing one of the three contacts shown. This is a short term operation existing only as the train passes over the offset portion 13A of the first loop and has no real effect since relay CS is already in its energized condition and held up by the stick circuit.

If section 4T is occupied so that relay 4TR is released, a STOP command is transmitted into loop 13 since back contact *b* of relay 4TR energizes that input of cab signal transmitter 20. At the same time, the transmission of any signal command into loop 16 is interrupted by front contact *a* of relay 4TR. The signal output produced by coil Y now actuates the cab signal apparatus to provide a STOP or restricted speed command which closes the STOP contact to retain relay CS energized by its stick circuit. When train V passes off loop 13 and over loop 16, no signal is then picked up by receiver coil Y since loop 16 is deenergized. This deactivates cab signal apparatus 24 so that the train is immediately brought to a stop. As previously explained, the preselected length of the offset portion 13A and thus of loop 16 is such that the train will stop, within the distance provided, from the restricted speed of 5 mph before passing beyond the insulated joint J which marks the terminus or exit of section 3T. With unit 24 deactivated, that is, no signal received, all contacts MAX, MED, MIN, and STOP are open and the stick circuit for relay CS is interrupted. With a STOP command signal in offset portion 13A of the first loop, cut-in receiver 25 is not properly actuated to close any of its contacts and thus relay CI is not energized. Thus, with its stick circuit open and front contact *a* of relay CI remaining open, relay CS is completely deenergized and releases to open its front contact *b* to deactivate or cut off cab signal apparatus 24.

Following this, the renewed operation of the cab signal apparatus and thus further train movement depends upon the receipt of a cut-in signal. When section 4T is cleared by the preceding train, transmitter 20 is activated by logic unit 21 to transmit better than a STOP signal through loop 13A and loop 13. Actually, with only section 4T cleared, the minimum speed signal is transmitted. If it is desired to provide greater headway between trains, the MIN contact of cut-in receiver 25 is omitted and a medium or maximum speed signal must be transmitted by cab signal transmitter 20 into the offset portion 13A before relay CI will then be energized. When relay CI is energized and picks up, the closing of its front contact *a* energizes relay CS which picks up. When front contact *b* of relay CS closes, cab signal apparatus 24 is reenergized. Since transmitter 20 is supplying a similar signal into loop 16, a signal is supplied by receiver coil Y to activate the cab signal apparatus to allow the train to move forward into section 4T.

It is obvious that the arrangement of our invention is not solely dependent upon conventional track circuits for operation. Other types of train detectors to register section occupancy may be used. An occupancy detector means equivalent to the track relay TR is then used to interrupt signal transmission to the second loop of the approach section. Thus, our system is not limited to steel wheel trains moving on steel rails. For example, rubber tire vehicles traveling on a concrete roadway may also be controlled. With little or no modifications, this loop arrangement may be adapted to other types of transportation systems.

This loop arrangement provided by our invention is thus a safe and efficient manner of controlling cab signal or speed control apparatus on trains. Trains are halted prior to entry into an occupied advance section by the absence of a signal in the wire loop at the exit end of the approach section. This also cuts off the train carried cab signal apparatus to prohibit further movement until a valid proceed signal is again received. The cab signal apparatus is only reset when the advance section is unoccupied and a minimum speed command again transmitted into the loops of the approach section to reset the cab signal apparatus. Thus no train can receive, from loops in the roadway, a more favorable signal which was intended for a preceding train. Safety is therefore maintained while providing an efficient and economical cab signal and speed control system for controlling the movement of trains.

Although we have herein shown and described but a single embodiment of the transmitting loop arrangement for railroad cab signals, it is to be understood that various modifications and changes within the scope of the appended claims may be made therein without departing from the spirit and scope of our invention.

Having now described the invention, what we claim as new and desire to secure by Letters Patent, is:

1. A loop arrangement for transmitting cab signal controls to a vehicle, provided with cab signal apparatus, traversing a stretch of fixed roadway divided into a plurality of sections, comprising in each section the combination of, a. first transmitting loop extending parallel to and within the section roadway generally along a first predetermined alignment but with an offset portion of preselected length at the section exit end positioned on a second predetermined alignment, b. a second loop of the same preselected length as said offset portion of said first loop positioned at the exit end parallel to and within the section roadway along said first predetermined alignment, c. a cab signal transmitter means at the exit end coupled to said first loop and responsive to advance traffic conditions along said stretch for transmitting into said first loop a selected one of a plurality of cab signal commands in accordance with the location of the next preceding vehicle, d. said cab signal transmitter means also coupled to said second loop for transmitting the same commands but responsive to the occupancy condition of the adjoining advance section for interrupting the transmission of cab signal commands when said adjoining advance section is occupied by a vehicle, e. a first cab signal pick-up means on each vehicle traversing the stretch positioned to respond to a loop signal in each loop positioned along said first predetermined alignment and coupled for actuating the associated cab signal apparatus to a movement control condition when a signal is present and to a cut-off condition when a signal is absent in such loop, and f. a second cab signal pick-up means on each vehicle positioned to respond to a signal in said offset portion of said first loop and coupled for resetting said associated cab signal apparatus from said cut-off condition to an active condition only when a proceed cab signal command is received from that loop.

2. A cab signal loop arrangement for each roadway section as defined in claim 1 in which, a. said preselected length is equal to the stopping distance of a vehicle from a restricted speed level, and b. said cab signal transmitter means is further responsive to the advance traffic conditions for transmitting a restricted speed command into said first loop and interrupting the transmission of any command into the associated second loop when the adjoining advance section is occupied by a vehicle.

3. A cab signal loop arrangement for each section as defined in claim 2 in which, a. said first predetermined alignment is the center line of the section roadway, and b. said second predetermined alignment is parallel to and adjacent one edge of said roadway.

4. A cab signal loop arrangement for each roadway section as defined in claim 3 which further includes, a. a vehicle detector means responsive to the passage of a vehicle through the section for registering the occupancy of that section by a vehicle, b. said vehicle detector means coupled for interrupting the transmission of cab signal commands into the second loop of the adjoining approach section when a vehicle occupancy is registered, c. said vehicle detector means further coupled for interrupting advance traffic control of the adjoining approach section transmitting means and for actuating that transmitter means to transmit only a restricted speed cab signal command into that approach section first loop, when a vehicle occupancy of the associated section is registered.

5. A cab signal loop arrangement as defined in claim 2 in which said fixed roadway is a stretch of railroad track divided into a plurality of insulated sections and said vehicles traversing the stretch are conventional trains, and further, for each section, in which, a. said first predetermined alignment is the center line of the track between the rails, and b. said second predetermined alignment is immediately adjacent one of the rails.

6. A cab signal loop arrangement for each track section as defined in claim 5 which further includes, a. a detector track circuit for the section coupled to the section rails for detecting section occupancy by a train, b. an advance traffic logic means controlled by the adjoining advance section track circuit and transmitter means and coupled to the associated transmitter means for selecting the cab signal command transmitted into the corresponding loops in accordance with the command transmitted in the adjoining advance section loops only when that advance section is unoccupied, and in which, c. said track circuit is coupled for interrupting the transmission of all commands into the adjoining approach section second loop when a train is detected occupying the corresponding section, and d. said track circuit is further coupled for deactivating the approach section advance traffic logic means and for actuating the approach section transmitter means to transmit only a restricted speed signal command into the approach section first loop when the corresponding section is occupied.

7. A cab signal control arrangement for a stretch of railroad track divided into a plurality of sections, and traversed by trains having cab signal apparatus responsive to signals received from the wayside right-of-way, comprising in combination, a. a first transmitting loop extending the length of each section between the rails, generally positioned along a first predetermined alignment but with an offset portion of preselected length along a different alignment at the exit end, b. a second transmitting loop in each section of said preselected length and positioned between the rails along said first predetermined alignment parallel to said offset portion of said first loop at the exit end, c. a cab signal transmitter means for each section coupled to the corresponding first and second loops at the section exit end and responsive to advance traffic conditions for transmitting one of a plurality of cab signal commands into each loop selected in accordance with the existing traffic conditions, d. a track occupancy detection means for each section coupled for registering occupancy of the section by a train, each track occupancy detection means further coupled for actuating the adjoining approach section transmitter means to transmit only a restricted signal command and for interrupting the transmission of signal commands into the adjoining approach section second loop, when a train occupancy of the associated section is registered, and f. a first and a second signal pick-up means on each train, 1. said first pick-up means inductively coupled for receiving signal commands transmitted in loops positioned along said first predetermined alignment, 2. said second pick-up means inductively coupled for receiving signal commands transmitted in the offset portion of each first loop, g. each first pick-up means coupled to said cab signal apparatus on that train for actuating a selected control of the train movement through each section in accordance with the selected signal command transmitted by the corresponding transmitter means, h. each cab signal apparatus responsive to the absence of a signal command in the second loop of a section to stop the train from a restricted speed level within the length of that second loop.

8. A cab signal control arrangement as defined in claim 7 in which, a. each cab signal apparatus is further responsive to the absence of a signal command in a second loop for inhibiting its own further operation until specifically reset, thereby holding the train halted over the second loop length, and b. each second pick-up means is coupled for resetting the associated cab signal apparatus to an active condition when selected ones of the signal commands are received from a first loop offset portion.

9. A cab signal control arrangement as defined in claim 8 in which, a. said first predetermined alignment is along the center line of the track, b. said different alignment is immediately adjacent one of the rails,

10. A cab signal control arrangement as defined in claim 9 in which, a. the preselected length of each second loop equals the stopping distance of a train from the restricted speed level, b. each track occupancy detector means is coupled to the adjoining approach section transmitter means for actuating the transmission of only a restricted speed command when the corresponding section is occupied.

11. A cab signal control arrangement as defined in claim 10 which further includes, a. an advance traffic logic means coupled to each transmitter means and further coupled for receiving the cab signal commands transmitted through the adjoining advance track section first loop, b. each traffic logic means activated by the advance section track occupancy detection means, only when that advance section is unoccupied, for selecting the cab signal command transmitted by the associated transmitter means into the corresponding section loops in accordance with the existing advance traffic conditions as designated by the specific cab signal command received, c. each track occupancy detection means further coupled for deactivating the approach section advance traffic logic means and for actuating the adjoining approach section transmitter means to transmit only a restricted speed signal command into the approach section first loop, when that detection means registers a track occupancy.

12. A cab signal control arrangement as defined in claim 11 in which, a. each track occupancy detection means is a track circuit including the section rails and a track relay operable to a first and a second position as the corresponding section is unoccupied and occupied, respectively, b. a first portion contact of each track relay is connected for controlling the transmission of cab signal commands into the adjoining approach section second loop, c. another first position contact of each track relay is connected for activating the approach section advance traffic logic means, and d. a second position contact of each track relay is connected for actuating the adjoining approach section transmitter means to transmit a restricted speed signal command into the associated first loop.

13. A cab signal control arrangement as defined in claim 10 in which trains move in either direction over said track stretch in accordance with the selected traffic direction, and which further includes, a. another offset portion of the first loop of each section, of said preselected length and positioned adjacent the other rail at the other end of the associated section, b. another second loop for each section positioned along the center line between the rails parallel to said other offset portion at the other end of the associated track section, and c. a third pick-up means on each train also coupled to the associated cab signal apparatus for supplying received signal commands and positioned for inductively receiving signal commands from the second offset portion of each first loop, and in which, d. each transmitter means is selectively coupled to the associated first and second loops of either adjoining section in accordance with the selected traffic direction so that the cab signal commands are only transmitted into loops at the exit end of an adjoining section under the existing traffic direction.

14. A cab signal control arrangement as defined in claim 13 which further includes, a. an advance traffic logic means coupled to each transmitter means, selectively controlled in accordance with the existing traffic direction by the track occupancy detection means for the adjoining advance track section and selectively coupled to the first loop of the adjoining advance track section in the selected traffic direction, b. each advance traffic logic means responsive to the signal commands received from the advance section first loop to which coupled, when that advance section is unoccupied, for selecting the cab signal commands transmitted by the associated transmitter means into the loops of the approach track section in accordance with advance traffic conditions designated by the received signal commands.

15. A cab signal control arrangement as defined in claim 14 in which, a. each train occupancy detection means is a track circuit including the rails of the associated section and a track relay operable to a first and a second position as that section is unoccupied and occupied, respectively, b. a selected first position contact of each track relay controlling the transmission of cab signal commands into the second loop of the adjoining approach section in the selected traffic direction, c. another first position contact of each track relay connected for activating the traffic logic means, at the entrance end of the corresponding section in the selected traffic direction, to respond to cab signal commands received from the advance section first loop, and d. a second position contact of each track relay selectively connected for actuating the transmitter means coupled to the first loop of the adjoining approach section, in the selected traffic direction, to transmit only a restricted speed signal command.

* * * * *

UNITED STATES PATENT OFFICE

CERTIFICATE OF CORRECTION

PATENT NO. : 4,026,506

DATED : May 31, 1977

INVENTOR(S) : Thomas J. Bourke and Kenneth J. Buzzard

It is certified that error appears in the above-identified patent and that said Letters Patent are hereby corrected as shown below:

Column 11, line 12, beford "first" insert --a--

Column 13, line 4, before "each" insert --e.--

Column 14, line 17, "portion" should be --position--

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*